US006796284B1

(12) United States Patent
Von Wielligh

(10) Patent No.: US 6,796,284 B1
(45) Date of Patent: Sep. 28, 2004

(54) SINGLE REVOLUTION CAM ENGINE

(76) Inventor: Wilhelm Von Wielligh, 113 Komatie Road Emmarentia, Johannesburg, 2195 (ZA)

( * ) Notice: Subject to any disclaimer, the term of this patent is extended or adjusted under 35 U.S.C. 154(b) by 0 days.

(21) Appl. No.: 10/440,554

(22) Filed: May 15, 2003

(51) Int. Cl.[7] ..... F02B 75/32
(52) U.S. Cl. ..... 123/197.1
(58) Field of Search ..... 123/197.4, 197.1, 123/54.3, 197.2, 55.3, 56.2–56.9

(56) References Cited

U.S. PATENT DOCUMENTS 4,510,894 A * 4/1985 Williams ..... 123/48 R
5,494,135 A * 2/1996 Brackett ..... 184/6.5
6,125,802 A * 10/2000 Pen ..... 123/48 B
6,223,703 B1 * 5/2001 Galvin ..... 123/48 B

* cited by examiner

*Primary Examiner*—Andrew M. Dolinar
*Assistant Examiner*—Katrina B. Harris

(57) ABSTRACT

A single revolution cam engine is provided, having four equidistant cams on a drive camshaft. Each cam has four equally spaced raised cam lobes. A roller bearing on a bearing pin contacts each cam and is connected to pin arms which contact compression springs, an allen cap screw is in contact with each compression spring, and a piston in a cylinder is in contact with each bearing pin. The single revolution cam engine has particular utility in connection with providing maximum engine power and performance, with power up to four times stronger than that of a conventional four-cycle engine.

20 Claims, 4 Drawing Sheets

SINGLE REVOLUTION CAM ENGINE

BACKGROUND OF THE INVENTION

1. Field of the Invention

The present invention relates to a single revolution cam engine for use in connection with motor vehicles. The single revolution cam engine has particular utility in connection with providing maximum engine power and performance.

2. Description of the Prior Art

Single revolution cam engines are desirable for providing maximum engine power and performance, with power up to four times stronger than that of a conventional four-cycle engine.

The use of engines is known in the prior art. For example, U.S. Pat. No. 3,584,610 to Porter discloses an internal combustion engine. However, the Porter '610 patent does not provide an engine with a drive camshaft having four equidistant rotating cams, each with four raised cam lobes around the outside for each cylinder, to accomplish four complete cycles in single revolution of 360 degrees for increased engine output power and performance.

U.S. Pat. No. 1,830,046 to White discloses an internal combustion engine. However, the White '046 patent does not provide an engine with a drive camshaft having four equidistant rotating cams, each with four raised cam lobes around the outside for each cylinder, to accomplish four complete cycles in single revolution of 360 degrees for increased engine output power and performance.

U.S. Pat. No. 3,735,741 to Hatz discloses a piston engine. However, the Hatz '741 patent does not provide an engine with a drive camshaft having four equidistant rotating cams, each with four raised cam lobes around the outside for each cylinder, to accomplish four complete cycles in single revolution of 360 degrees for increased engine output power and performance.

U.S. Pat. No. 1,904,680 to Ferry discloses a radial cam type internal combustion engine. However, the Ferry '680 patent does not provide an engine with a drive camshaft having four equidistant rotating cams, each with four raised cam lobes around the outside for each cylinder, to accomplish four complete cycles in single revolution of 360 degrees for increased engine output power and performance.

U.S. Pat. No. 4,848,282 to Chaneac discloses a combustion engine having no connecting rods or crankshaft, of the radial cylinder type. However, the Chaneac '282 patent does not provide an engine with a drive camshaft having four equidistant rotating cams, each with four raised cam lobes around the outside for each cylinder, to accomplish four complete cycles in single revolution of 360 degrees for increased engine output power and performance.

Lastly, U.S. Pat. No. 4,214,557 to Beach, Jr. discloses a pivoting wall type four stroke internal combustion rotary engine. However, the Beach, Jr. '557 patent does not provide an engine with a drive camshaft having four equidistant rotating cams, each with four raised cam lobes around the outside for each cylinder, to accomplish four complete cycles in single revolution of 360 degrees for increased engine output power and performance.

While the above-described devices fulfill their respective, particular objectives and requirements, the aforementioned patents do not describe a single revolution cam engine that provides maximum engine power and performance, with power up to four times stronger than that of a conventional four-cycle engine. The prior art patents make no provision for an engine with a drive camshaft having four equidistant rotating cams, each with four raised cam lobes around the outside for each cylinder, to accomplish four complete cycles in single revolution of 360 degrees for increased engine output power and performance.

Therefore, a need exists for a new and improved single revolution cam engine that can be used for providing maximum engine power and performance, with power up to four times stronger than that of a conventional four-cycle engine. In this regard, the present invention substantially fulfills this need. In this respect, the single revolution cam engine according to the present invention substantially departs from the conventional concepts and designs of the prior art, and in doing so provides an apparatus primarily developed for the purpose of providing maximum engine power and performance.

SUMMARY OF THE INVENTION

In view of the foregoing disadvantages inherent in the known types of engines now present in the prior art, the present invention provides an improved single revolution cam engine, and overcomes the above-mentioned disadvantages and drawbacks of the prior art. As such, the general purpose of the present invention, which will be described subsequently in greater detail, is to provide a new and improved single revolution cam engine and method which has all the advantages of the prior art mentioned heretofore and many novel features that result in a single revolution cam engine which is not anticipated, rendered obvious, suggested, or even implied by the prior art, either alone or in any combination thereof.

To attain this, the present invention essentially comprises a single revolution cam engine, comprising a drive camshaft, a plurality of equidistant cams encircling the drive camshaft with each cam comprising a plurality of equally spaced raised cam lobes, a roller bearing in contact with each cam with each roller bearing defining an interior area therein, a bearing pin inserted through the interior area of each roller bearing, a pin arm connected to each bearing pin on each side of each roller bearing, a compression spring in contact with each pin arm, a spring sleeve around each compression spring, a cap screw in contact with each compression spring, a piston in contact with each bearing pin, and a cylinder around each piston.

In one embodiment, the present invention comprises a single revolution cam engine, comprising a drive camshaft, four equidistant cams encircling the drive camshaft with each cam comprising four equally spaced raised cam lobes, a roller bearing in contact with each cam with each roller bearing defining an interior area therein, a bearing pin inserted through the interior area of each roller bearing, a pin arm connected to each bearing pin on each side of each roller bearing, a compression spring in contact with each pin arm, a spring sleeve around each compression spring, a cap screw in contact with each compression spring, a piston in contact with each bearing pin, and a cylinder around each piston.

In another embodiment, the present invention comprises a single revolution cam engine, comprising a drive camshaft, four equidistant cams encircling the drive camshaft with each cam comprising four equally spaced raised cam lobes, two cam clips holding each cam in place around the drive camshaft, a roller bearing in contact with each cam with each roller bearing defining an interior area therein, a bearing pin inserted through the interior area of each roller bearing, a pin arm connected to each bearing pin on each side of each roller bearing, a plurality of pin clips holding each bearing pin in place, a compression spring in contact with each pin arm, a spring sleeve around each compression spring, an alien cap screw in contact with each compression spring, a piston in contact with each bearing pin, and a cylinder around each piston.

There has thus been outlined, rather broadly, the more important features of the invention in order that the detailed description thereof that follows may be better understood and in order that the present contribution to the art may be better appreciated.

The invention may also include exhaust valves and inlet valves. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved single revolution cam engine that has all of the advantages of the prior art engines and none of the disadvantages.

It is another object of the present invention to provide a new and improved single revolution cam engine that may be easily and efficiently manufactured and marketed.

An even further object of the present invention is to provide a new and improved single revolution cam engine that has a low cost of manufacture with regard to both materials and labor, and which accordingly is then susceptible of low prices of sale to the consuming public, thereby making such single revolution cam engine economically available to the buying public.

Still another object of the present invention is to provide a new single revolution cam engine that provides in the apparatuses and methods of the prior art some of the advantages thereof, while simultaneously overcoming some of the disadvantages normally associated therewith.

Even still another object of the present invention is to provide a single revolution cam engine for providing maximum engine power and performance. This allows an increase in engine capabilities and efficiency.

Still yet another object of the present invention is to provide a single revolution cam engine for providing maximum engine power and performance, with power up to four times stronger than that of a conventional four-cycle engine. This makes it possible to provide powerful engines for very demanding applications.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
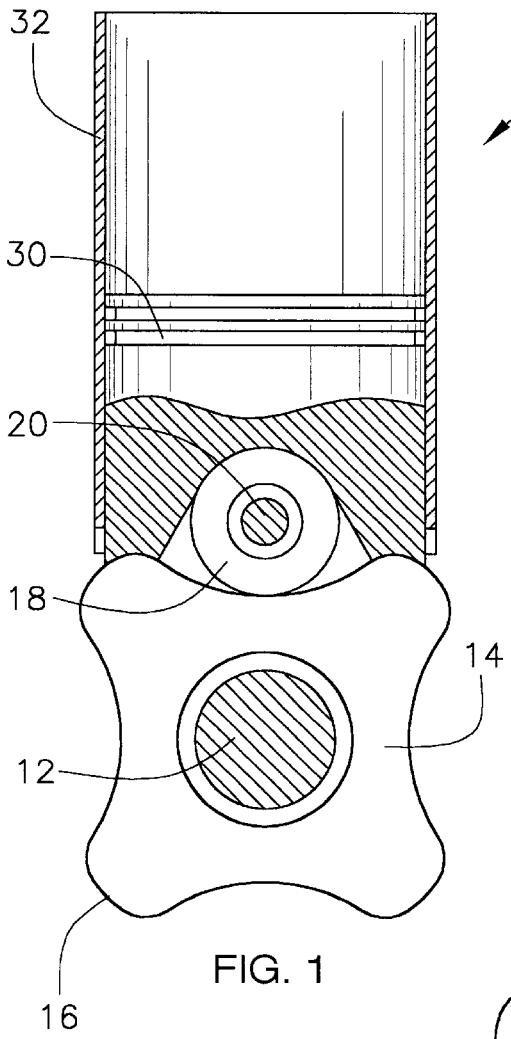
FIG. 1 is a side elevational sectional view of a bottom stroke configuration of a preferred embodiment of the single revolution cam engine constructed in accordance with the principles of the present invention.

Referring now to the drawings, and particularly to FIGS. 1–6, a preferred embodiment of the single revolution cam engine of the present invention is shown and generally designated by the reference numeral 10.

In FIG. 1, a new and improved single revolution cam engine 10 of the present invention for providing maximum engine power and performance is illustrated and will be described. More particularly, in this embodiment a side elevational sectional view of a bottom stroke configuration of the single revolution cam engine 10 is illustrated, and comprises a drive camshaft 12, a cam 14 encircling the drive camshaft 12 with the cam 14 comprising four equally spaced raised cam lobes 16, a roller bearing 18 in contact with the cam 14, a bearing pin 20 inserted through the roller bearing 18, a piston 30 in contact with the roller bearing 18, and a cylinder 32 around the piston 30.

Figure 2:
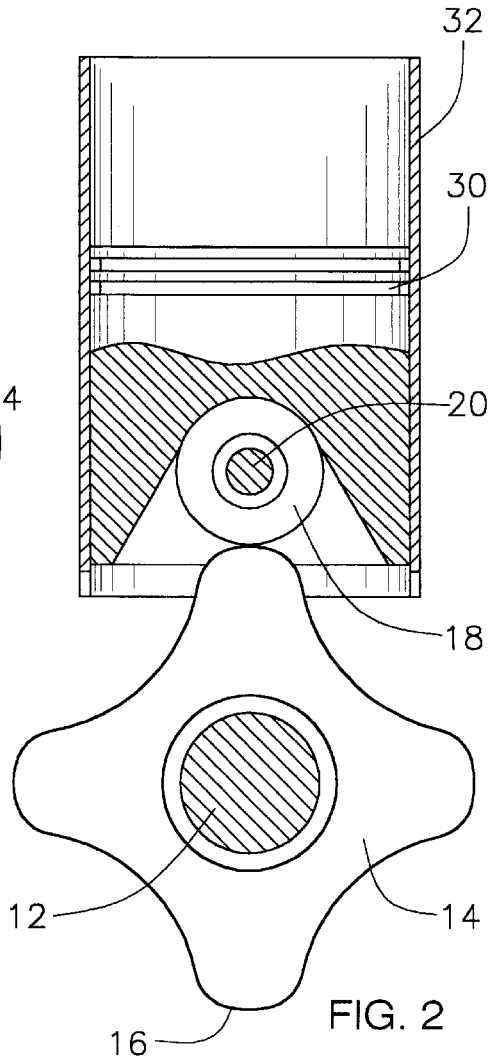
FIG. 2 is a side elevational sectional view of a compression stroke configuration of the single revolution cam engine of the present invention.

FIG. 2 is a side elevational sectional view of a compression stroke configuration of the single revolution cam engine of the present invention, and illustrates a drive camshaft 12, a cam 14 encircling the drive camshaft 12 with the cam 14 comprising four equally spaced raised cam lobes 16, a roller bearing 18 in contact with the cam 14, a bearing pin 20 inserted through the roller bearing 18, a piston 30 in contact with the roller bearing 18, and a cylinder 32 around the piston 30.

Figure 3:
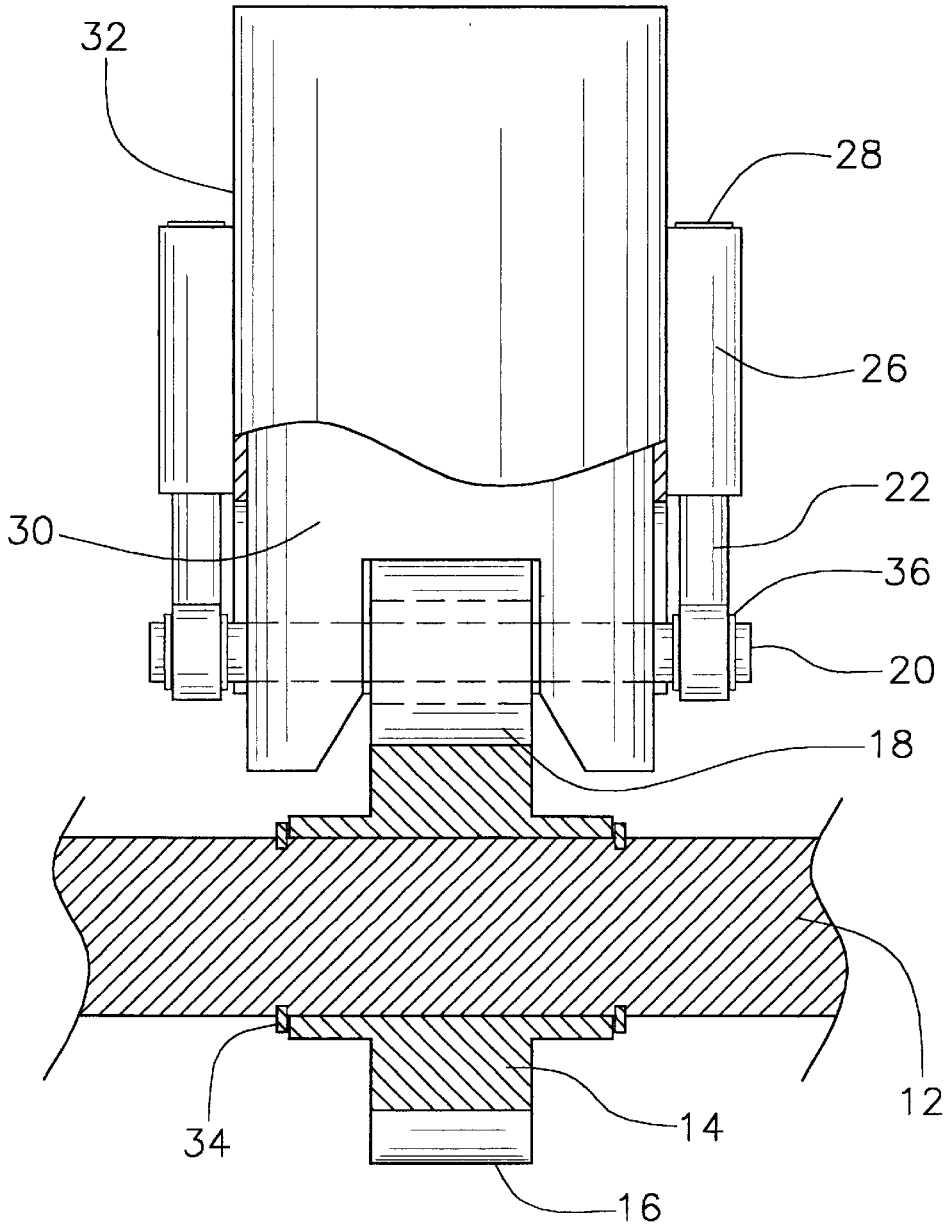
FIG. 3 is a front elevational sectional view of the single revolution cam engine of the present invention.

FIG. 3 is a front elevational sectional view of the single revolution cam engine of the present invention, and illustrates a drive camshaft 12, a cam 14 encircling the drive camshaft 12 with the cam 14 comprising raised cam lobes 16, two cam clips 34 holding the cam 14 in place around the drive camshaft 12, a roller bearing 18 in contact with the cam 14, a bearing pin 20 inserted through the roller bearing 18, pin arms 22 connected to the bearing pin 20, pin clips 36 holding the bearing pin 20 in place, spring sleeves 26 around the pin arms 22, alien cap screws 28 in contact with the spring sleeves 26, a cylinder 32 in contact with the spring sleeves 26, and a piston 30 inside the cylinder 32.

Figure 4:
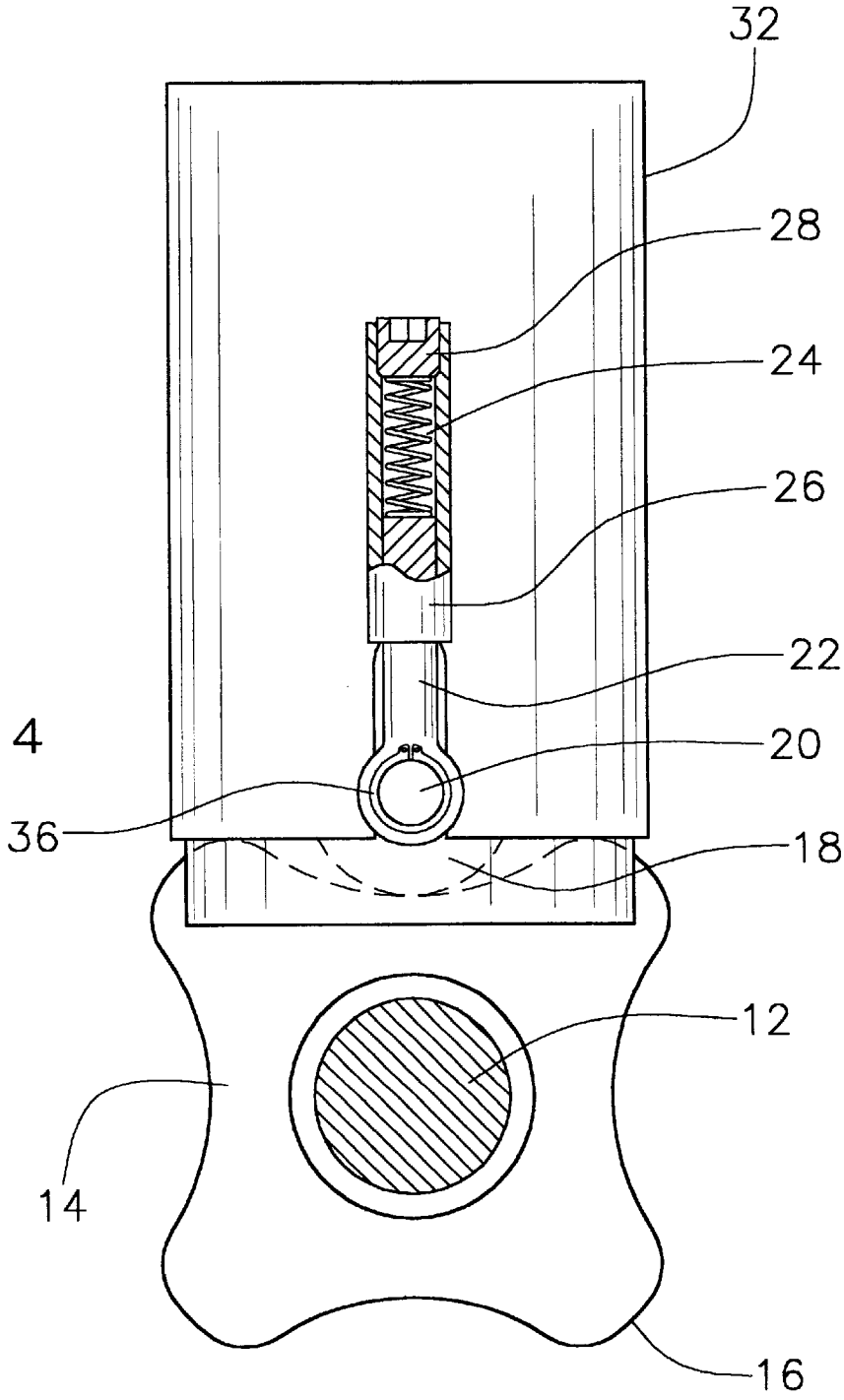
FIG. 4 is a side elevational cut-away view of the single revolution cam engine of the present invention.

FIG. 4 is a side elevational cut-away view of the single revolution cam engine of the present invention, and illustrates a drive camshaft 12, a cam 14 encircling the drive camshaft 12 with the cam 14 comprising four equally spaced raised cam lobes 16, a roller bearing 18 in contact with the cam 14, a bearing pin 20 inserted through the roller bearing 18, a pin arm 22 connected to the bearing pin 20, a pin clip 36 holding the bearing pin 20 in place, a compression spring 24 in contact with the pin arm 22, a spring sleeve 26 around the compression spring 24, an allen cap screw 28 in contact with the compression spring 24, and a cylinder 32 in contact with the spring sleeve 26.

Figure 5:
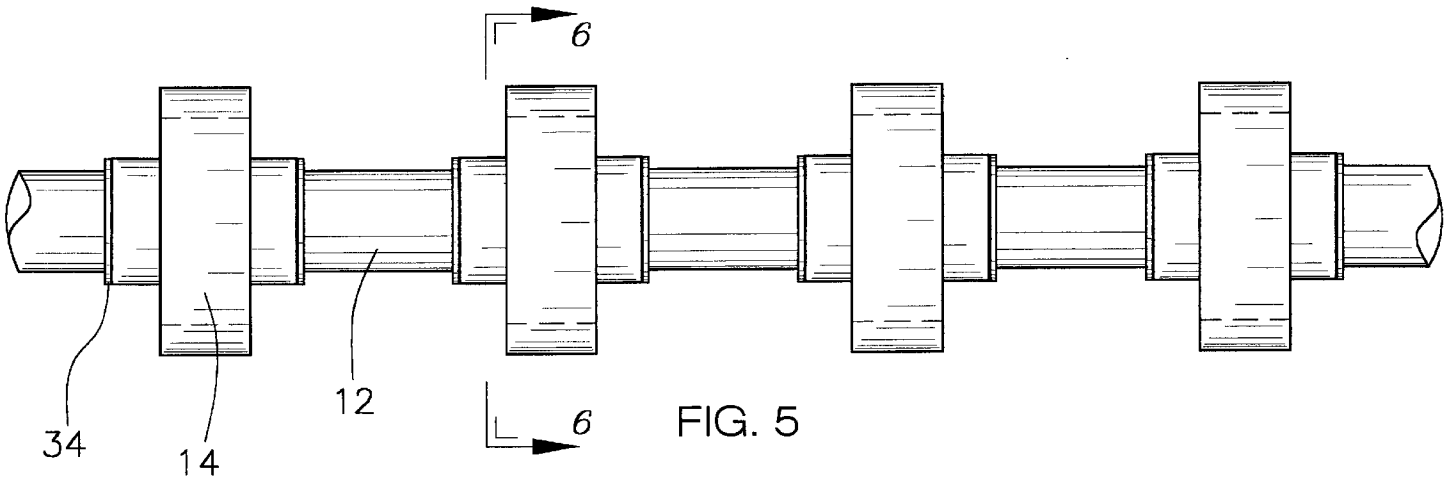
FIG. 5 is a front elevational view of the shaft and cams of the single revolution cam engine of the present invention.

FIG. 5 is a front elevational view of the drive camshaft 12 and cams 14 of the single revolution cam engine of the present invention, and illustrates two cam clips 34 holding each cam 14 in place around the drive camshaft 12.

Figure 6:
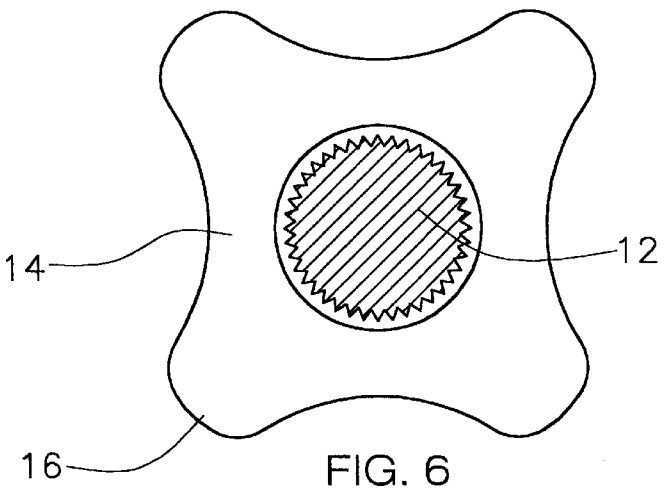
FIG. 6 is a side elevational cross-sectional view of the shaft and cam of the single revolution cam engine of the present invention illustrated in FIG. 5 and taken along the line 6—6.

FIG. 6 is a side elevational cross-sectional view of the shaft 12 and cam 14 of the single revolution cam engine of the present invention, and illustrates four equally spaced raised cam lobes 16.

The single revolution cam engine is an internal combustion engine designed to power wheels without the use of a conventional crankshaft. It utilizes a drive camshaft that completes four complete cycles in single revolution of 360 degrees, thus making the engine four times stronger in single revolution than a four-stroke engine. This provides added power and performance on the road for improved vehicle operation by motorists.

In some embodiments, the single revolution cam engine is approximately the same size and shape as other internal combustion engines. It burns fuel within the cylinders and fires in order with an electronic ignition. Instead of using a conventional crankshaft to deliver power, this engine employs a drive camshaft with four lobes for each cylinder. The horizontal drive camshaft has four equidistant rotating cams, each with four raised cam lobes around the outside to drive the pistons upward within the cylinders. The four equally spaced lobes around the outside of each cam are rounded at the outermost points, with shallow concave surfaces between them. This type of surface for the individual cams enables the pistons to be raised and lowered four times with each rotation. The piston stroke may be adjusted to be longer or shorter by machining the cam lobe deeper or shallower. In different embodiments, differently sized rotating cam lobes are used on the cam drive shaft for different engine sizes.

In different embodiments, the single revolution cam engine has a camshaft to operate the valves, or splined cam lobes fitted to the drive camshaft, thereby controlling movement of the piston and the movement of exhaust valves and inlet valves in pairs for each piston. These lobes are adjusted on splines to suit each compression stroke and exhaust and inlet strokes. The piston is pushed down on the camshaft by means of two coil springs which are contained within and fitted to the engine block by two adjustable sleeves. These springs are adjustable equally to the correct tension. The tension is equal on both springs of each cylinder to ensure that the roller bearing at the underside of the piston stays in contact with the camshaft at all times by means of slots in the bottom end of the cylinder block.

In operation, the individual pistons of the single revolution cam engine are fired four complete times with one rotation of the cam crankshaft. This enables maximum power and performance to be derived, with power up to four times stronger than a conventional four-cycle engine. The single revolution cam engine may be used in a wide range of new motor vehicle applications, including commercial trucks, cars, light trucks, buses, and RVs. It may also be used in aftermarket applications as an engine replacement. In different embodiments, the single revolution cam engine has utility for motorcycles, lawn mowers, ATVs, and various other types of engine-driven equipment.

The single revolution cam engine fulfills the need for a new engine design for quadrupling engine output power. Advantages may include increased efficiency and improved fuel economy. The appealing features of the single revolution cam engine include its high efficiency, improved power, and reliability. Instead of achieving one power stroke with each engine rpm, this engine is designed to deliver four. This makes the engine four times stronger in single revolution than a conventional four-stroke engine. It increases overall power output for the motorist for greater passing power and acceleration from a standstill. This boosts overall performance on the road, making the vehicle more responsive and more exciting to drive. In addition, the single revolution cam engine is strong, reliable, and adaptable to different applications.

In one embodiment, the single revolution cam engine comprises a drive camshaft, a plurality of equidistant cams encircling the drive camshaft with each cam comprising a plurality of equally spaced raised cam lobes, a roller bearing in contact with each cam with each roller bearing defining an interior area therein, a bearing pin inserted through the interior area of each roller bearing, a pin arm connected to each bearing pin on each side of each roller bearing, a compression spring in contact with each pin arm, a spring sleeve around each compression spring, a cap screw in contact with each compression spring, a piston in contact with each bearing pin, and a cylinder around each piston.

In another embodiment, the single revolution cam engine comprises a drive camshaft, four equidistant cams encircling the drive camshaft with each cam comprising four equally spaced raised cam lobes, a roller bearing in contact with each cam with each roller bearing defining an interior area therein, a bearing pin inserted through the interior area of each roller bearing, a pin arm connected to each bearing pin on each side of each roller bearing, a compression spring in contact with each pin arm, a spring sleeve around each compression spring, a cap screw in contact with each compression spring, a piston in contact with each bearing pin, and a cylinder around each piston.

In still another embodiment, the single revolution cam engine comprises a drive camshaft, four equidistant cams encircling the drive camshaft with each cam comprising four equally spaced raised cam lobes, two cam clips holding each cam in place around the drive camshaft, a roller bearing in contact with each cam with each roller bearing defining an interior area therein, a bearing pin inserted through the interior area of each roller bearing, a pin arm connected to each bearing pin on each side of each roller bearing, a plurality of pin clips holding each bearing pin in place, a compression spring in contact with each pin arm, a spring sleeve around each compression spring, an allen cap screw in contact with each compression spring, a piston in contact with each bearing pin, and a cylinder around each piston.

In another embodiment, the present invention further comprises an exhaust valve and an inlet valve in contact with each piston. Electronic ignition may be employed to initiate the burning of fuel within the cylinders, and the pistons are raised and lowered multiple times with each rotation of the drive camshaft. In certain embodiments, the spring sleeves are adjustable, and the cam lobes are rounded at their outermost points, with shallow concave surfaces between the cam lobes.

In use, it can now be understood that the single revolution cam engine of the present invention has particular utility in connection with providing maximum engine power and performance, with power up to four times stronger than that of a conventional four-cycle engine.

While a preferred embodiment of the single revolution cam engine has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, steel or any high strength metal may be used. Also, different numbers of cams and cam lobes may be used for different power requirements. And although providing maximum engine power and performance has been described, it should be appreciated that the single revolution cam engine herein described is suitable for any engine-driven equipment. Furthermore, a wide variety of differently sized rotating cam lobes may be used for different engine sizes. In addition, it is to be understood that the various described embodiments may be combined.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A single revolution cam engine, comprising:

a drive camshaft;

a plurality of equidistant cams encircling said drive camshaft, each said cam comprising a plurality of equally spaced raised cam lobes;

a roller bearing in contact with each said cam, each said roller bearing defining an interior area therein;

a bearing pin inserted through said interior area of each said roller bearing;

a pin arm connected to each said bearing pin on each side of each said roller bearing;

a compression spring in contact with each said pin arm;

a spring sleeve around each said compression spring;

a cap screw in contact with each said compression spring;

a piston in contact with each said bearing pin; and a cylinder around each said piston.

2. The single revolution cam engine of claim 1, comprising four cams.

3. The single revolution cam engine of claim 1, wherein said cams comprise four equally spaced raised cam lobes.

4. The single revolution cam engine of claim 1, wherein said cap screws are allen cap screws.

5. The single revolution cam engine of claim 1, further comprising two cam clips holding each said cam in place around said drive camshaft.

6. The single revolution cam engine of claim 1, further comprising a plurality of pin clips holding said bearing pins in place.

7. The single revolution cam engine of claim 1, wherein said spring sleeves are adjustable.

8. The single revolution cam engine of claim 1, wherein said pistons are raised and lowered at least two times with each rotation of said drive camshaft.

9. A single revolution cam engine, comprising:

a drive camshaft;

four equidistant cams encircling said drive camshaft, each said cam comprising four equally spaced raised cam lobes;

a roller bearing in contact with each said cam, each said roller bearing defining an interior area therein;

a bearing pin inserted through said interior area of each said roller bearing;

a pin arm connected to each said bearing pin on each side of each said roller bearing;

a compression spring in contact with each said pin arm;

a spring sleeve around each said compression spring;

a cap screw in contact with each said compression spring;

a piston in contact with each said bearing pin; and a cylinder around each said piston.

10. The single revolution cam engine of claim 9, wherein said cap screws are allen cap screws.

11. The single revolution cam engine of claim 9, further comprising two cam clips holding each said cam in place around said drive camshaft.

12. The single revolution cam engine of claim 9, further comprising a plurality of pin clips holding said bearing pins in place.

13. The single revolution cam engine of claim 9, wherein said spring sleeves are adjustable.

14. The single revolution cam engine of claim 9, wherein said pistons are raised and lowered four times with each rotation of said drive camshaft.

15. A single revolution cam engine, comprising:

a drive camshaft;

four equidistant cams encircling said drive camshaft, each said cam comprising four equally spaced raised cam lobes;

two cam clips holding each said cam in place around said drive camshaft;

a roller bearing in contact with each said cam, each said roller bearing defining an interior area therein;

a bearing pin inserted through said interior area of each said roller bearing;

a pin arm connected to each said bearing pin on each side of each said roller bearing;

a plurality of pin clips holding each said bearing pin in place;

a compression spring in contact with each said pin arm;

a spring sleeve around each said compression spring;

an allen cap screw in contact with each said compression spring;

a piston in contact with each said bearing pin; and a cylinder around each said piston.

16. The single revolution cam engine of claim 15, further comprising an exhaust valve and an inlet valve in contact with each piston.

17. The single revolution cam engine of claim 15, wherein said cam lobes are rounded at their outermost points, with shallow concave surfaces between said cam lobes.

18. The single revolution cam engine of claim 15, wherein said spring sleeves are adjustable.

19. The single revolution cam engine of claim 15, wherein said pistons are raised and lowered four times with each rotation of said drive camshaft.

20. The single revolution cam engine of claim 15, wherein electronic ignition initiates the burning of fuel within each said cylinder.

* * * * *